US008918928B2

(12) United States Patent
Verschuere et al.

(10) Patent No.: US 8,918,928 B2
(45) Date of Patent: Dec. 30, 2014

(54) ADJUSTABLE BED SYSTEM

(75) Inventors: Frank Verschuere, Laarne (BE); Peter De Meyer, Sint-Laureins (BE)

(73) Assignee: LS Bedding, Maldegem (BE)

( * ) Notice: Subject to any disclaimer, the term of this patent is extended or adjusted under 35 U.S.C. 154(b) by 284 days.

(21) Appl. No.: 13/121,745

(22) PCT Filed: Sep. 30, 2008

(86) PCT No.: PCT/EP2008/063099
§ 371 (c)(1),
(2), (4) Date: Jul. 12, 2011

(87) PCT Pub. No.: WO2010/037415
PCT Pub. Date: Apr. 8, 2010

(65) Prior Publication Data

US 2011/0258772 A1 Oct. 27, 2011

(51) Int. Cl.
*A47C 31/00* (2006.01)
*A47C 23/043* (2006.01)

(52) U.S. Cl.
CPC ..... *A47C 23/0435* (2013.01); *Y10S 5/934* (2013.01)
USPC ..... 5/11; 5/613; 5/934; 267/89

(58) Field of Classification Search
CPC ..... A61G 7/0573; A61G 7/015; A47C 23/067
USPC ..... 5/11, 933, 934, 236.1, 239, 243, 612, 5/613; 267/89
See application file for complete search history.

(56) References Cited

U.S. PATENT DOCUMENTS

| | | | | | |
|---|---|---|---|---|---|
| 131,034 | A | * | 9/1872 | Spencer | 5/617 |
| 2,112,702 | A | * | 3/1938 | Loibl | 5/600 |
| 2,445,158 | A | * | 7/1948 | Sparhawk | 5/611 |
| 2,804,128 | A | * | 8/1957 | Barath | 267/89 |
| 3,059,249 | A | | 10/1962 | Kamp | |
| 3,339,214 | A | | 9/1967 | Janapol | |
| 3,340,548 | A | * | 9/1967 | Janapol | 5/243 |
| 4,494,260 | A | * | 1/1985 | Olds et al. | 5/613 |
| 4,625,487 | A | * | 12/1986 | Blakeway | 5/613 |
| 4,768,240 | A | * | 9/1988 | Benoit | 5/53.3 |

(Continued)

FOREIGN PATENT DOCUMENTS

| | | | |
|---|---|---|---|
| DE | 202011052296 U1 | * | 3/2012 |
| DE | 102012005143 | * | 9/2013 |

(Continued)

*Primary Examiner* — Robert G Santos
*Assistant Examiner* — Myles Throop
(74) *Attorney, Agent, or Firm* — Jacobson Holman Hershkovitz PLLC

(57) ABSTRACT

The present invention relates to a bed system which comprises a mattress supporting structure. The bed system comprises a height adjustment system which comprises at least one rotatable multi-angular transverse beam comprising a plurality of transverse beam sides and an eccentric rotation axis which is accessible from outside said outer frame. The height adjustment system further comprises a rotation imparting member which is accessible from outside the outer frame and provided for rotating said at least one rotatable transverse beam about its eccentric axis. Said rotation imparting member is displaceable between a first and a second position. The first position is provided for rotating said at least one rotatable transverse beam about its eccentric axis and said second position is provided for blocking said at least one rotatable transverse beam in a desired height position with respect to said outer frame.

12 Claims, 4 Drawing Sheets

(56) References Cited

U.S. PATENT DOCUMENTS

| | | | | |
|---|---|---|---|---|
| 4,999,861 | A * | 3/1991 | Huang | 5/600 |
| 5,060,636 | A * | 10/1991 | Bell | 606/243 |
| 5,857,891 | A * | 1/1999 | Dahlgren | 446/153 |
| 6,360,386 | B1 * | 3/2002 | Chuang | 5/618 |
| 6,689,076 | B2 * | 2/2004 | Saringer | 601/90 |
| 6,964,355 | B2 * | 11/2005 | Landau | 222/185.1 |
| 7,159,255 | B2 * | 1/2007 | Piraino | 5/238 |
| 7,210,181 | B1 | 5/2007 | Price | |
| 7,481,130 | B2 * | 1/2009 | Yamada et al. | 74/493 |
| 7,818,831 | B2 * | 10/2010 | Mahdjoubi | 5/81.1 R |
| 8,418,284 | B2 * | 4/2013 | Bonac | 5/236.1 |
| 2004/0098805 | A1 * | 5/2004 | Piraino | 5/613 |
| 2006/0147256 | A1 * | 7/2006 | Richardson et al. | 403/91 |

FOREIGN PATENT DOCUMENTS

| | | | |
|---|---|---|---|
| EP | 1410742 | B1 | 3/2006 |
| EP | 1969973 | A3 * | 10/2008 |
| EP | 2090196 | A3 * | 10/2009 |
| GB | 2077580 | A * | 12/1981 |

* cited by examiner

ADJUSTABLE BED SYSTEM

The present invention relates to a bed system comprising a mattress supporting structure, which comprises an outer frame having a first and a second transverse side on opposite transverse sides of the frame and a first and a second longitudinal side on opposite longitudinal sides of the outer frame; a plurality of adjacent transverse beams, each of the transverse beams being connected with a first transversal end to the first longitudinal side of the outer frame and with a second transversal end to the second longitudinal side of the outer frame; at least one of said transverse beams being a multi-angular transverse beam having a plurality of transverse beam sides and being rotatable about an eccentric rotation axis which is accessible from outside said outer frame; a plurality of springs provided within the outer frame and mounted on top of the plurality of transverse beams; a height adjustment system which comprises said at least one rotatable transverse beam and a rotation imparting member which is accessible from outside the outer frame along a longitudinal side of the outer frame and which is provided for imparting a rotation to said at least one rotatable transverse beam about its eccentric axis, according to the preamble of the first claim.

A standard bed system usually comprises an upper mattress which is placed on top of a mattress supporting structure. Said mattress supporting structure usually comprises a base structure on which a spring package, which is usually encapsulated in a soft material, is fixed. The carcass formed by the base structure and springs package is then covered with a textile material, such that, an aesthetically attractive piece of furniture is created.

Standard bed systems provide an equal support to all body parts of an individual, independent of his shape and weight. However, different body parts require a different orthopaedic support. Moreover, different adult human bodies may have significant shape and weight differences, which may even vary during lifetime, for instance as a result of pregnancy, overweight or illness.

In order to enhance user comfort and in particular orthopaedic support, several bed systems have been developed in which height differences were built in the mattress supporting structure in a fixed manner. U.S. Pat. No. 7,210,181 describes for instance a bed system with a mattress supporting structure comprising a number of transverse slats. The slats are provided to support a plurality of springs. The transverse slats are divided in first and second slats, which support respectively first and second springs. The height of the first and second slats and the spring constant of the first and second springs are chosen such that a different support is provided: slats with small height and springs with a high spring constant are provided in the region supporting the shoulders, hips and legs; slats with larger height and springs with a smaller spring constant are provided in the region supporting the other human body parts. This type of bed system has the disadvantage that, because the height differences are built in the mattress structure in a fixed manner, the bed system may not be adapted to changes of the human body over time.

In order to solve this problem, EP-B-1410742 provides a bed system with a mattress supporting structure in which the amount of support may be adapted to changes in the human body profile over time. The mattress supporting structure comprises an outer frame and a plurality of height adjusting means installed in the outer frame and which align with corresponding adjustment means on a cushion element. The cushion element fits with vertical movement into the outer frame. In a first embodiment described in EP-B-1410742, the height adjustment means comprise a number of protrusions rotatably mounted to the outer frame. The cushion element comprises a frame, springs and a padding layer covering the springs. The cushion element further comprises a number of three-levelled recesses which, when fitted into the outer frame, block the protrusions in one of three positions. Such a bed system has the disadvantage that it is only possible to adjust a limited area of the mattress supporting structure, namely a part which has the length of the cushion. Another disadvantage is that the height adjustment is cumbersome and requires a plurality of different steps to be carried out. Moreover, because the left and right side of the bed need to be separately installed, it is likely that the installation is done incorrectly and that an instable supporting structure is obtained. In a second preferred embodiment described in EP-B-1410742, the height adjustment means comprise a plurality of triangular rotation means, which are rotatable about an eccentric axis and as such provide three different height levels for the supporting slats and thus for the springs supported by the slats. Such a bed system has the disadvantage that the contact surface between the triangular rotation means and the supporting slats is too small to provide in a stabile support for the upper mattress. Another disadvantage is that no means are provided to block the position of the triangular rotation means, as a result of which returning of the rotation means as a result of a dynamic load cannot be avoided. Another disadvantage is that the triangular rotation means do not directly support the springs, but additional slats are needed on top of the rotation means to support the springs. As a result, the height of the mattress supporting system is adversely increased by the height adjustment means. In a third preferred embodiment described in EP-B-1410742, the height adjustment system comprises disks which are eccentrically mounted on a continuous shaft mounted in the outer frame. The shaft may be rotated with a crank handle which is accessible from outside the outer frame. A cushion element is mounted on top of the rotatable transverse disks. Such a bed system presents the disadvantage that the height adjustment system is infinitely variable which makes it difficult to provide the user with a correct orthopaedic advice. This is due to the fact that the measurement error—in a, in view of adjustment-advice, analysis of the body profile of the user—becomes higher than the height difference between subsequent height positions, which makes the advice incorrect and subjective. In case the number of possible height positions is too large, the risk to incorrect installation increases accordingly.

It is therefore an object of the present invention to provide a mattress supporting system with a height adjustment system with a reduced risk to returning to a previous or other position, which provides the mattress supporting system with a limited number of different height positions.

This is achieved according to the present invention with a mattress supporting system showing the technical features of the characterizing part of the first claim.

Thereto, the bed system according to the present invention is characterized in that said rotation imparting member is displaceable between a first position in which rotation of said at least one rotatable transverse beam about its eccentric axis is permitted—and a second position in which said at least one rotatable transverse beam is blocked in a desired position with respect to said outer frame.

The mattress supporting structure comprises an outer frame with a first and a second transverse side on opposite transverse sides of the frame, and a first and a second longitudinal side on opposite longitudinal sides of the frame. The mattress supporting structure further comprises a plurality of transverse beams, the end parts of which are each connected to opposite longitudinal sides of the outer frame. At least one of said transverse beams is rotatably mounted to the outer frame, about an eccentric rotation axis which is accessible from outside the outer frame. This means that the rotatable transverse beam may be rotated about its eccentric axis without involving the need to dismantle the mattress supporting structure either fully or partly. Said at least one rotatable transverse beam has a multi-angular cross section and comprises a number of transverse beam sides, for supporting a plurality of springs, mounted on top of said plurality of transverse beams. Said at least one rotatable transverse beam forms part of a height adjustment system of said mattress supporting structure. Said height adjustment system further comprises a rotation imparting member which is accessible from outside the outer frame and provided for rotating said transverse beams about their eccentric rotation axis. By rotating said transverse beams about their eccentric rotation axis, the position of the transverse beam side which supports the springs is changed in height direction with respect to the outer frame. As a result, by rotating said transverse beams, the springs are elevated or lowered in comparison to their initial position and give the mattress supporting structure a profiled shape. Said rotation imparting member is displaceable between a first and a second position. In the first position rotation of said at least one rotatable transverse beam about its eccentric rotation axis is permitted; in the second position blocking said at least one rotatable transverse beam in a desired height position with respect to said outer frame is permitted.

The mattress supporting structure according to the present invention presents the advantage that only a limited number of positions may be taken in height direction of the frame. The maximum number of possible height positions corresponds to the number of sides of the multi-angle of the rotatable transverse beam. This way advising of the consumer and the provision of an optimal installment of the overall system is facilitated. Another advantage is that the presence of a limited number of height positions, permits the consumer to install the height of a certain area of the supporting system himself, at minimum risk to instable or incorrect installment. Moreover, the specific heights and height differences between different positions can be exactly defined and they are in fact determined by the distance between the center of the eccentric rotation axis and each of the transverse beam sides. This distance can be chosen and optimized during production.

Another advantage of the mattress supporting structure according to the present invention is that the height adjustment system comprises a blocking mechanism for blocking the position of said rotatable beam in a desired position, so that the position of the side supporting the mattress in height direction of the outer frame is fixed. As a result, there is a minimum risk to returning of the rotatable transverse beam to its lowest position, which may for instance occur as a result of dynamic forces exerted on the upper mattress and/or on the supporting structure. As a result, the mattress supporting system provides in a more stable adjustable supporting system as compared to the prior art systems.

Another advantage is that the height of the support surface of the springs resting onto the at least one rotatable beam can be easily adjusted. By rotating the rotation imparting means, which are accessible from the outside of at least one of the longitudinal sides of the outer frame of the mattress supporting structure, the position of the transverse beam with respect to the outer frame may be changed, thereby the height of the support surface is changed. This adjustment does not involve the need to remove parts of the mattress supporting system.

The rotation imparting means are accessible from outside at least one of the longitudinal sides of the outer frame of the mattress supporting structure. Preferably, the eccentric rotation axis extends from the first longitudinal side of the outer frame to the second longitudinal side, such that rotation of the rotation imparting member can be imparted from one longitudinal side of the outer frame only, and results in a rotation of the entire transverse beam. This way, adjustment of the height of the supporting surface of the springs can be carried out in one single step and the risk to incorrect and unstable installment as a result of a different height position at both longitudinal ends of the outer frame is minimized.

Preferably, said plurality of springs is directly supported by one of said transverse beam sides. Due to this direct support the supporting transverse beam sides then function as the supporting slats for the springs. This is contrary to the prior art systems where in addition to eccentrically rotatable height adjustment system additional supporting slats had to be provided. The direct support permits minimizing the risk that the height of the mattress supporting system would be adversely affected by the rotatable height adjustment element. Said plurality of springs may be in direct contact with a transverse beam side or an additional layer may be provided between the springs and the transverse beam side to smoothen the transition between subsequent transverse beams.

Preferably, the bed system according to the present invention comprises a plurality of adjacent multi-angular rotatable transverse beams mounted on a distance from each other in longitudinal direction of the outer frame. Said plurality of adjacent rotatable transverse beams, may be provided along the entire length of the outer frame or only along a specific area of the outer frame. Preferably, at least that area of the outer frame which is likely to receive body parts which require a different support or a support which may vary over time, is provided with said rotatable transverse beams. Because each of said rotatable transverse beams comprises a height adjustment system which is accessible from outside, each of these transverse beams can be rotated individually about its eccentric axis and installed on a specific height with respect to the outer frame. Because each of these rotatable beams is individually rotatable, different parts of the human body can be provided with a different support. When said plurality of rotatable transverse beams is for instance provided from the head region to the hip region of the outer frame, the rotatable transverse beams provided in the head region may be installed on a different height with respect to the outer frame compared to the hip region, and thus provide in a different support for the head and the hip of the person lying on top of the bed system. Moreover, such a system allows the user to adjust the amount of support of different human body parts over time.

The invention is further elucidated in the appending figures and description of the figures.

FIGS. 1A and 1B show a mattress supporting structure of a bed system according to the present invention.

FIGS. 2A and 2B respectively show a 3-dimensional view and a cross section of a preferred embodiment of a rotatable transverse beam according to the present invention.

Figure 1A:
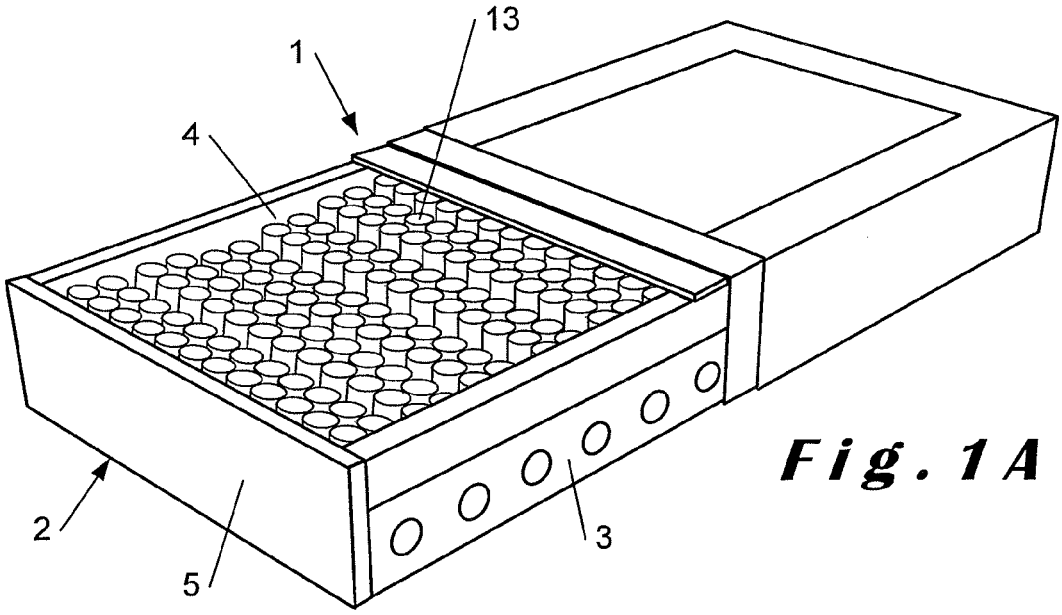
Figure 1B:
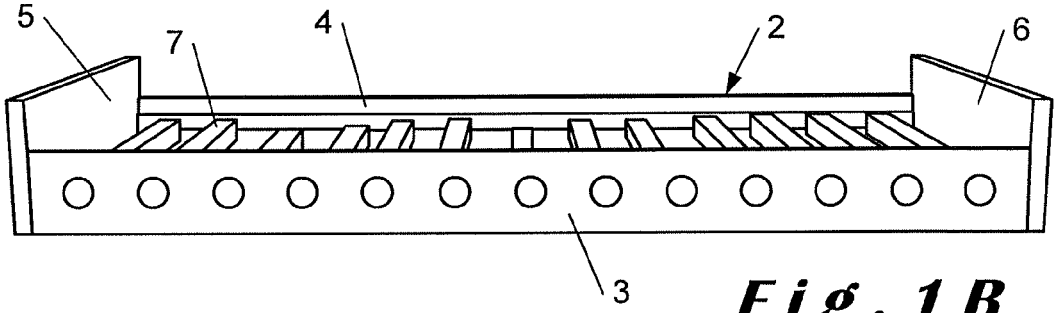

FIGS. 1A and 1B show a preferred embodiment of a mattress supporting structure 1 of a bed system according to the present invention. Said mattress supporting structure 1 comprises an outer frame 2 comprising two transverse sides 5, 6 and two longitudinal 3, 4 sides. Said supporting structure 1 further comprises a plurality of adjacent transverse beams 7, each of them being 2 0 connected with a first transversal end to a first longitudinal side 3 of the outer frame and with a second transversal end to a second longitudinal side 4, opposite the first longitudinal side 3, of the outer frame 2. The beams 7 are provided on a distance from each other and extend in longitudinal direction of the outer frame 2 one next to the other. A plurality of springs 13 is provided within the outer frame 2 and mounted on top of said plurality of transverse beams 7. The mattress supporting structure 1 formed by said plurality of springs 13, said outer frame 2 and said plurality of transverse beams 7 is preferably covered with a textile material, as is shown in FIG. 1A to enhance the aesthetic view of the overall bed system. An upper mattress (not shown) is then preferably provided on top of the covered mattress supporting structure, such that a box spring bed system is obtained. Alternatively, the mattress supporting structure may at the same time function as the mattress of the bed system and the user may lay directly onto the mattress supporting structure 1.

Figure 2A:
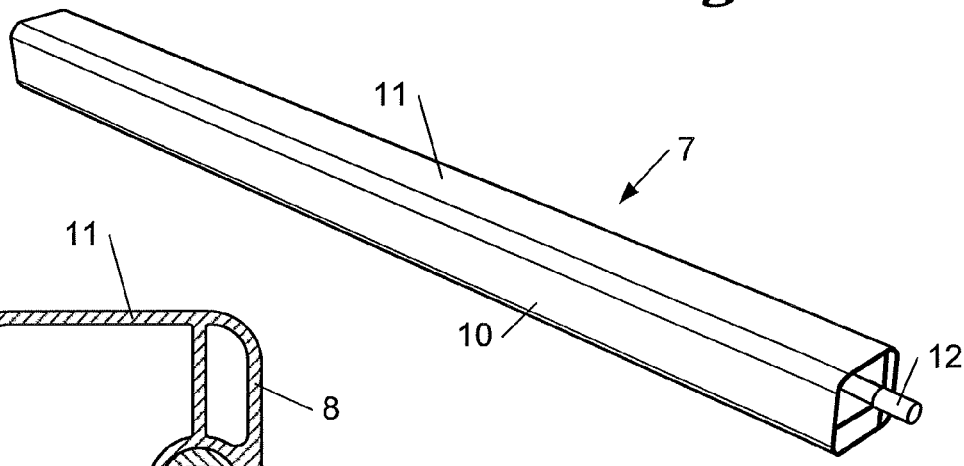
Figure 2B:
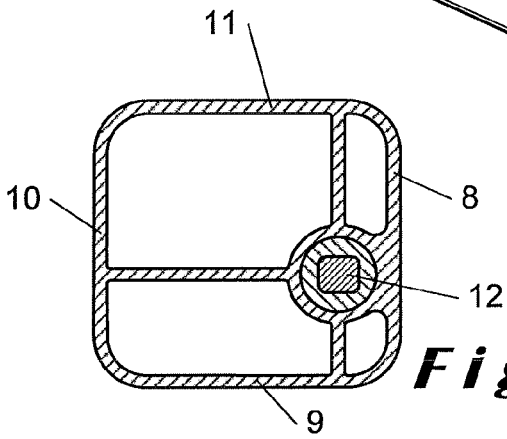

At least one of said adjacent transverse beams is a multi-angular rotatable transverse beam 7 as shown in FIG. 1B and as shown in detail in FIGS. 2A and 2B. Said at least one multi-angular rotatable transverse beam 7 comprises an eccentric rotation axis 12 which is accessible from outside the outer frame 2. Said at least one rotatable transverse beam 7 further comprises a plurality of transverse beam sides 8, 9, 10, 11, oriented with respect to each other such that a multi-angular transverse beam 7 is formed as is for instance shown in FIGS. 2A and 2B. FIGS. 2A and 2B show a rotatable transverse beam 7 with a quadrangular cross section comprising four transverse beam sides 8, 9, 10, 11 which together form a quadrangle. However, the multi-angular rotatable transverse beam may have any other type of cross section considered suitable by the person skilled in the art, such as a triangular cross section defined by three transverse beam sides which together form a tri-angle. One of said transverse beam sides acts as the support surface for at least one row of springs of said plurality of springs. The row of springs 13 may be in direct contact with one of said transverse beam sides or an additional layer may be provided in between the top beam side and the springs.

By rotating said rotatable transverse beam 7 about its eccentric axis 12, the top transverse beam side 11, i.e. the transverse beam side which supports the springs 13, will obtain a different height with respect to the outer frame 2. As a result, the springs 13 resting on top of the top transverse beam side 11, will be positioned higher or lower, depending on the specific position of the top transverse beam side 11 with respect to the outer frame 2. The rotatable transverse beam 7 shown in FIG. 2B comprises for instance a first 10, second 11, third 9 and fourth 8 transverse beam side. The first transverse beam side 10 has the highest position with respect to the outer frame 2 and positions the springs 13 at the highest position with respect to the outer frame 2. The fourth transverse beam side 8 has the lowest position with respect to the outer frame 2 and positions the springs 13 on the lowest position with respect to the outer frame 2. The rotatable transverse beam 7 preferably functions as a direct support surface for the springs 13 mounted on top of the beam, and is, at the same time, able to adjust its height with respect to the outer frame 2. As a result, because no additional supporting slats are needed on top of the rotatable transverse beam 7 for supporting the springs 13, a reduction of the overall height and weight of the mattress supporting structure 1 may be obtained compared to the prior art systems.

The rotation of said rotatable transverse beam 7 about its eccentric axis 12 is done with part of a height adjustment system of the bed system, and in particular with the aid of a rotation imparting member 14 of a height adjustment system which is accessible from outside the outer frame 2. Said rotation imparting member 14 may be any type of member considered suitable by the person skilled in the art. Said rotation imparting member may be a part of the rotatable transverse beam itself, for instance in the form of a recess which is accessible from outside and which extends in longitudinal direction of the eccentric rotation axis, but is preferably a separate member connectable to the rotatable transverse beam. Such a separate rotation imparting member 14 may for instance take the form of an element, which fits into an opening of a longitudinal side of the outer frame, and which comprises a protruding part which at least partly extends within the inside of the outer frame and which at least partly corresponds to a corresponding part of a rotatable transverse beam or of a beam member mounted onto the rotatable transverse beam and which extends in longitudinal direction of the eccentric rotation axis of the rotatable transverse beam. Such a protruding part may fit around or within a protruding part of the rotatable transverse beam or beam member or within a grooved part of the rotatable transverse beam or beam member. By accessing the rotation imparting member 14 from outside the outer frame 2 and rotating it, said rotatable transverse beam 7 may be rotated and a height adjustment may be obtained.

The rotation imparting member 14 may be provided at both opposite longitudinal sides 3, 4 of the outer frame or at only one longitudinal side 3 of the outer frame. Because one single rotation imparting member 14 allows adjusting the height of the entire transverse beam 7 along its entire length, it is no longer necessary to adjust the height at both ends of the outer frame. This reduces the risk to wrong installation, i.e. installation of a different height at both ends of the transverse beam, and thus the risk to an instable mattress supporting structure.

The number of transverse beam sides determines the maximum number of different height positions of the rotatable transverse beam with respect to the outer frame. By allowing only a limited number of height positions, a better orthopaedic advice may be given to the consumer. Moreover, a mattress supporting system 1 with a limited number of height positions also allows the user to install the height of the rotatable transverse beam himself, with a reduced risk for incorrect installment. The rotatable transverse beam 7 as shown in FIGS. 2A and 2B allows for instance to position the top transverse beam side in four different height positions with respect to the outer frame. Preferably, the different height positions are chosen in such a way that they are a multiple of each other. The first transverse beam side 10 may for instance be located at a distance 4× of the eccentric rotation axis, the second transverse 11 beam at a distance 3×, the third transverse beam side 9 at a distance 2×, . . .

In FIG. 1A two rows of springs 13 are supported by one transverse beam side, but any other number of rows of springs considered suitable by the person skilled in the art may be provided on top of one transverse beam side.

Figure 3:
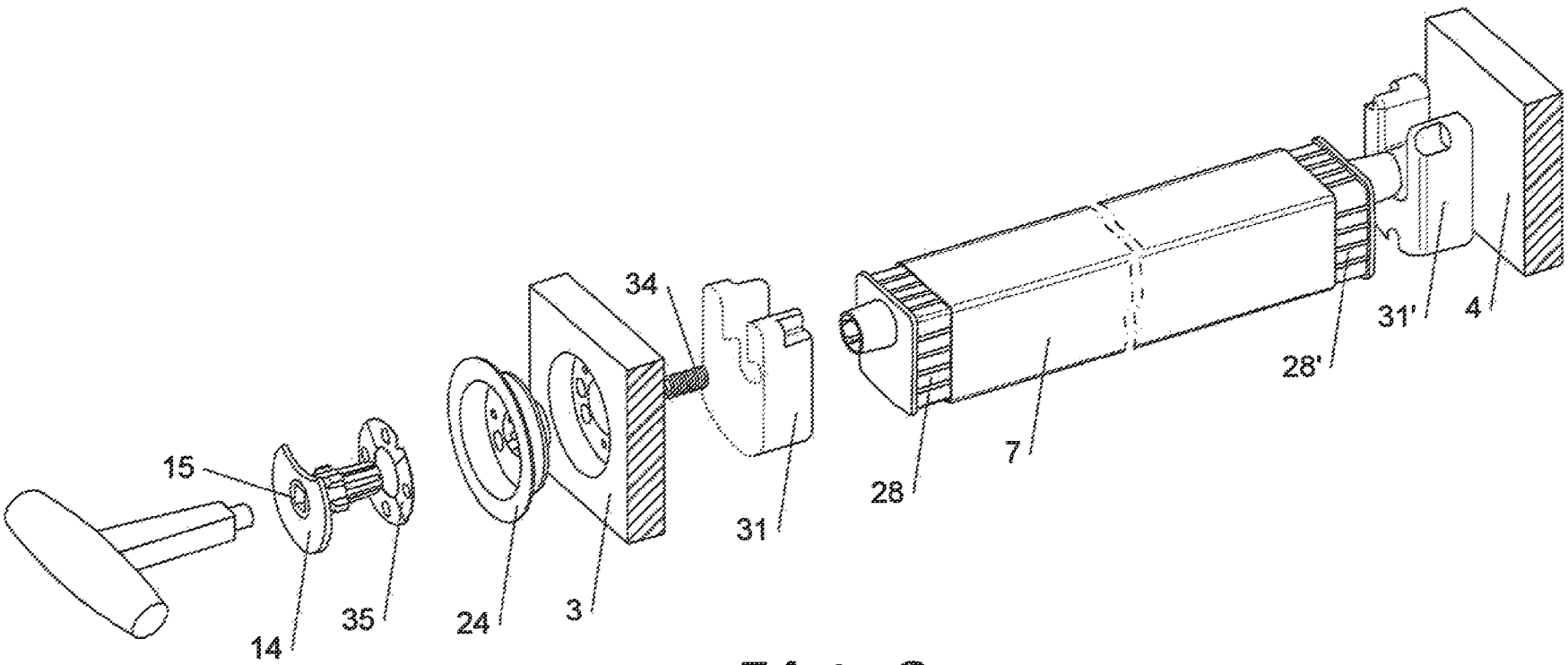
FIG. 3 shows a preferred embodiment of the different parts of a modular height adjustment system of a bed system according to the present invention.

The surface of the transverse beam sides 8, 9, 10, 11 may be flat as shown in FIG. 3 or curved. Preferably, the surface of the transverse beam sides is curved in such a way that the top of the curve is, for each of the transverse beam sides, located on a line perpendicular to the horizontal plane of the mattress supporting structure and passing through the centre of the eccentric rotation axis. In this way the top of the top transverse beam side stays at the same position, irrespective of its specific height position and thus irrespective of which of the transverse beam sides is located on top. Such a curved surface allows to always installing the height of the transverse beam on exactly the same transverse position with respect to the outer frame.

The width of the different transverse beam sides 8, 9, 10, 11 of one rotatable transverse beam 7 may by equal to each other as shown in FIGS. 2A and 2B or may vary. Preferably, the width of the different transverse beam sides 8, 9, 10, 11 is large enough as to provide in a large contact surface with the springs 13. A large contact surface between the springs 13 and the transverse beam side 8, 9, 10, 11 is preferred since this provides in a more stable mattress supporting structure 1, which shows in a better resistance against dynamic and static forces exerted onto the bed system. However, the width of the different transverse beam sides of a rotatable transverse beam is limited because the larger the width is, the higher the mattress supporting structure will be, which is not always desired.

The rotation imparting member 14 of the height adjustment system is displaceable between a first and a second position. Said first position 20 is provided for rotating said at least one rotatable transverse beam about its eccentric axis and said second position 21 is provided for blocking said at least one rotatable transverse beam in a desired height position with respect to the outer frame. Said blocking part 21 of said rotation imparting member 14 is accessible from outside the outer frame, which means that the rotatable transverse beam may be blocked in a desired height position without removing part of or the entire mattress supporting system. The blocking part 21 provides the bed system with a more stable adjustable supporting system as compared to the prior art document and avoids that the rotatable transverse beam falls back to its lowest position after being rotated by the rotation imparting member 14.

Said rotation imparting member 14 may be part of the rotatable transverse beam 7 itself, for instance in the form of at least one positioning means which cooperates with corresponding positioning means of the outer frame of the mattress supporting structure or of another part of the height adjustment system. Preferably the rotation imparting member 14 is provided as a separate member comprising at least one blocking region 21 which cooperates with a corresponding region 25 of the outer frame of the mattress supporting structure or of another part of the height adjustment system.

The mattress supporting structure 1 as shown in FIGS. 1A and 1B comprises a number of rotatable transverse beams 7 provided along the outer frame 2. Said rotatable transverse beams 7 preferably extend parallel with respect to each other as is shown in FIGS. 1A and 1B, but may extend under any other angle with respect to each other considered suitable by the person skilled in the art. A plurality of rotatable transverse beams 7 may be provided along the entire outer frame 2 as is shown in FIGS. 1A and 1B, or only along one or more specific regions. In this last case, said mattress supporting structure comprises a first region, which comprises one or more fixed transverse beams, extending between opposite longitudinal sides of the mattress supporting structure and comprising a fixed top transverse beam side which has a fixed height position with respect to the outer frame and which is provided as a supporting surface for at least one row of springs, and a second region, which comprises one or more rotatable transverse beams, extending between opposite longitudinal sides of the mattress supporting structure and comprising a top transverse beam side which has an adjustable height position with respect to the outer frame and which is provided as a supporting surface for at least one row of springs. Preferably, the springs are in direct contact with the top transverse beam side of the transverse beams. Preferably, said plurality of rotatable transverse beams are at least provided between the head and hip region of the outer frame, i.e. the region of the mattress supporting structure which is provided to support respectively the head and the hip. These regions are at least preferred, because the human body parts provided in these regions, i.e. the head, shoulders, chest, loins or lumbar region and hips, require a different support, which may even vary during its lifetime. FIG. 1B shows a mattress supporting structure which comprises a number of parallel extending rotatable transverse beams 7, provided along the entire length of the outer frame 2 on a distance d from each other, the height of the top transverse beam sides 11 of the different rotatable transverse beams 7 with respect to the outer frame 2 differing depending on the relative height position of that human body part in relation to the body profile, i.e. the amount of support or relief needed for that human body part lying on top of that transverse beam.

According to a preferred embodiment of the bed system according to the present invention, the cross section of the rotatable transverse beams 7 provided along the outer frame 2 differs. As explained above, the type of cross section of a rotatable transverse beam 7, and as such the number of transverse beam sides 8, 9, 10, 11, determines the maximum number of height positions of that specific rotatable transverse beam 7. By adjusting the cross section of different rotatable transverse beams 7 along the length of the outer frame, the height of the supporting surface can be adjusted for different human body parts. This allows for instance to provide the mattress supporting structure 1 with rotatable transverse beams with a pentagonal cross section, i.e. a higher number of transverse beam sides, in those regions which receive body parts which are likely to change to a great extend over time, such as for instance the hips and loins, for instance as a result of pregnancy, and rotatable transverse beams with a triangular cross section, i.e. a lower number of transverse beam sides, in those regions which receive body parts which are less likely to change to a large extend over time.

Preferably, the bed system according to the present invention comprises a modular height adjustment system, comprising one or more different parts which are removably mountable to the outer frame and/or to the rotatable transverse beam. Such a modular system has the advantage that it results in a longer term reduced cost for the consumer. If one of the height adjustment parts is damaged, it is not necessary to throw away the entire mattress supporting structure or the entire outer frame or rotatable transverse beam, but it is sufficient to replace only that part of the system that is damaged. Another advantage of such a modular height adjustment system is that the modular design allows manufacturing different parts separately. It may even allow different parts to be manufactured on different locations and/or in different countries and/or by different companies, which means that the parts can be manufactured at the lowest possible cost. A modular height adjustment system also simplifies the manufacturing process of the overall system.

A preferred embodiment of a modular height adjustment system is shown in FIG. 3.

Figure 4:
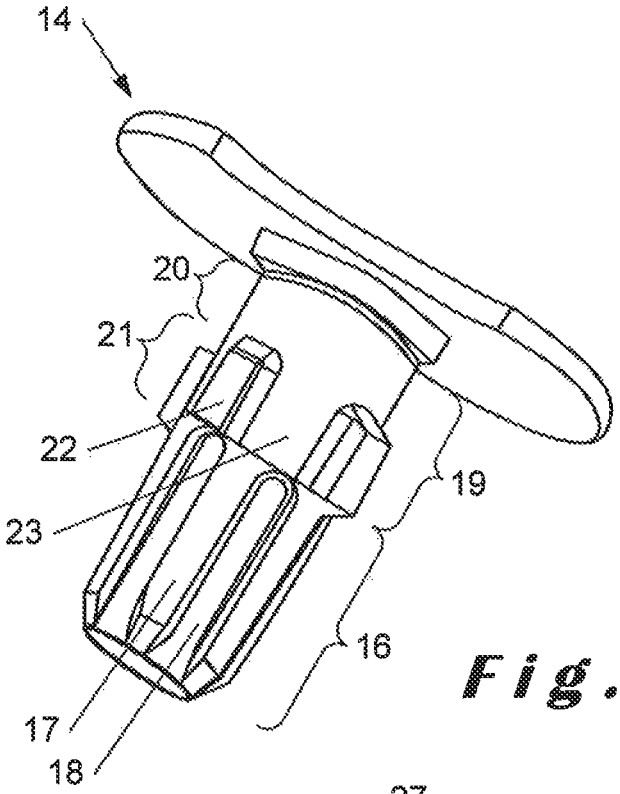
FIG. 4 shows a preferred embodiment of the connector of a modular height adjustment system according to the present invention.

The modular height adjustment system preferably comprises a connector 14 which functions as a rotation imparting member and is provided to impart a rotation of said at least one rotatable transverse beam 7 about its eccentric rotation axis and which is provided to cooperate with the outer frame. A preferred embodiment of the connector 14 is shown in FIG. 3 and in detail in FIG. 4. The connector 14 shown in FIG. 4 comprises a protrusion which fits into an opening of a longitudinal side of the outer frame and at least partly extends within the inside of the outer frame. The protrusion shown in FIG. 4 takes the form of a hollow cylinder, but any other shape considered suitable by the person skilled in the art is possible. The cylinder does not necessarily need to be hollow but may for instance be a solid cylinder which comprises a recess 15 which is accessible from outside the outer frame. A hollow cylinder has the advantage that it has a low weight, is easily accessible from outside, and may be directly fitted into and onto a part extending in longitudinal direction of the eccentric axis of the rotatable transverse beam to which it is connected. The hollow cylinder comprises a first connector region 16 which cooperates with a corresponding first beam region 30 of a rotatable transverse beam 7, shown in FIG. 6. The first connector region 16 as shown in FIG. 4 comprises a number of alternating first grooves 18 and projections 17 that cooperate with corresponding second projections and grooves on the rotatable transverse beam. The first connector 16 and beam 30 region may comprise any other type of cooperating positioning means considered suitable by the person skilled in the art, such as a cooperating circular groove provided on the first connector region which cooperates with a corresponding circular protrusion on the first beam region. Because of these cooperating first connector and beam region, a rotation of said hollow cylinder of the connector will be converted into a rotation of said rotatable transverse beam about its eccentric axis.

The hollow cylinder further comprises a gripping member 15 which is accessible from outside the outer frame and which is provided for rotating said connector and said at least one beam to which it is connected about its eccentric rotation axis. The gripping member 15 may have the form of a recess provided in the hollow cylinder or any other type of gripping member considered suitable by the person skilled in the art. The rotation may for instance be obtained by inserting a key in the hollow cylinder and rotating it as shown in FIG. 3. In order to avoid that the hollow protruding part completely passes through the outer frame to the inside of the outer frame, the hollow protrusion is preferably held back by a plate which is larger than the opening in the outer frame as shown in FIGS. 3 and 4.

Figure 5:
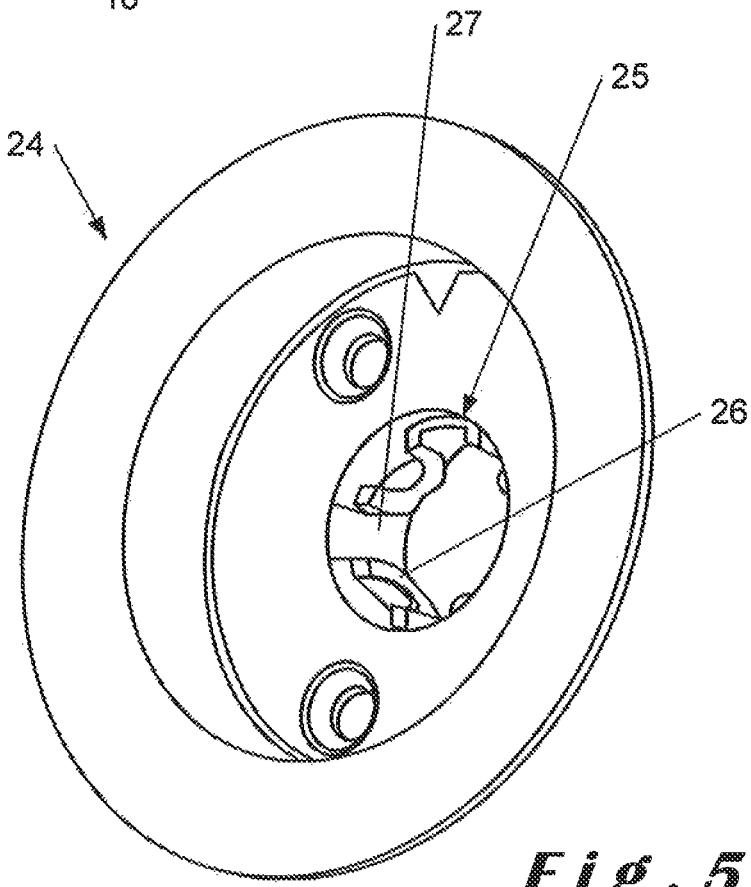
FIG. 5 shows a preferred embodiment of the housing of a modular height adjustment system according to the present invention.

Said hollow cylinder further comprises a second connector region 19, provided adjacent the first connector region 16 and preferably at a position closer to the outer frame 2. The second connector region 19 comprises an installment part 20 which allows rotating said connector and said rotatable beam and a blocking part 21 which allows blocking of said connector and said rotatable beam in a desired position. The installment part 20 shown in FIG. 4 comprises a smooth cylindrical part and allows freely rotating of said connector. Any other type of installment part considered suitable by the person skilled in the art is possible. The blocking part 21 shown in FIG. 4 is a corrugated part comprising a number of alternating recesses 23 and protrusions 22 which are provided to cooperate with corresponding protrusions 26 and recesses 27 in the outer frame 2 or any other part of the modular height adjustment system as shown in FIG. 5. The alternation of these protrusions 22, 26 and recesses 23, 27 is preferably such that the rotatable transverse beam 7 can be blocked in the number of height positions determined by the number of transverse beam sides. Preferably the installment part 20 is provided closest to the outer frame 2, whereas the blocking part 21 is provided on a further distance of the outer frame 2 as is shown in FIGS. 3 and 4.

The use of a connector 14 has the advantage that it functions both as rotation imparting member, provided for rotating said at least one rotatable transverse beam about its eccentric axis, as well as a part of a blocking mechanism provided for blocking said at least one rotatable transverse beam in a desired height position. The connector shown in FIG. 4 provides thus in a very compact way in a height adjustment system suitable for adjusting and blocking the desired height of the rotatable transverse beam 7. Moreover, it does not adversely influence the height and the weight of the overall mattress supporting system 1.

The connector 14 shown in FIG. 4 may be fitted directly into an opening of the outer frame 2 or may be fitted into a housing 24 which is directly mounted in an opening of the outer frame 2. FIGS. 3 and 5 show a preferred embodiment of a housing 24 which is provided to be directly mounted in an opening of a longitudinal side 3 of the outer frame 2. The housing 24 comprises a recess part which is provided to receive the protrusion of the connector. The recess part of the housing shown in FIG. 5 comprises a hollow cylindrical housing part which is provided to receive the hollow cylindrical protrusion of the connector. However, any other recess part of the housing considered suitable by the person skilled in the art is possible, provided that it is able to receive the protrusion of the connector. Said hollow cylindrical housing part comprises a housing blocking part 25 provided to cooperate with the blocking part 21 of the connector 14 to block the at least one rotatable beam 7 in a desired position. The housing blocking part 25 of the housing 24 shown in FIG. 5 comprises a number of alternating protrusions 26 and recesses 27 which are provided to cooperate with corresponding recesses 23 and protrusions 22 of the blocking part 21 of the connector 14. By inserting the connector 14 into the housing 24 and pushing its smooth cylindrical part 20 behind the housing blocking part 25, the connector 14 may freely rotate and a desired height may be installed. By pulling the connector 14 back to the outer frame 2, after being rotated, the blocking part of the connector 21 will fit into the housing blocking part 25 and the desired height position will be installed. The use of a housing 24 has the advantage that it is not necessarily to replace the entire outer frame in case there is damage to the cooperating recesses and protrusions, which results in lower replacement costs. Preferably, the shape of the protrusions 26 of the housing blocking part are designed in such a way that the connector may only be mounted to the housing in one possible way, such that the risk to wrong installation of the modular height adjustment system may be minimized.

Figure 6:
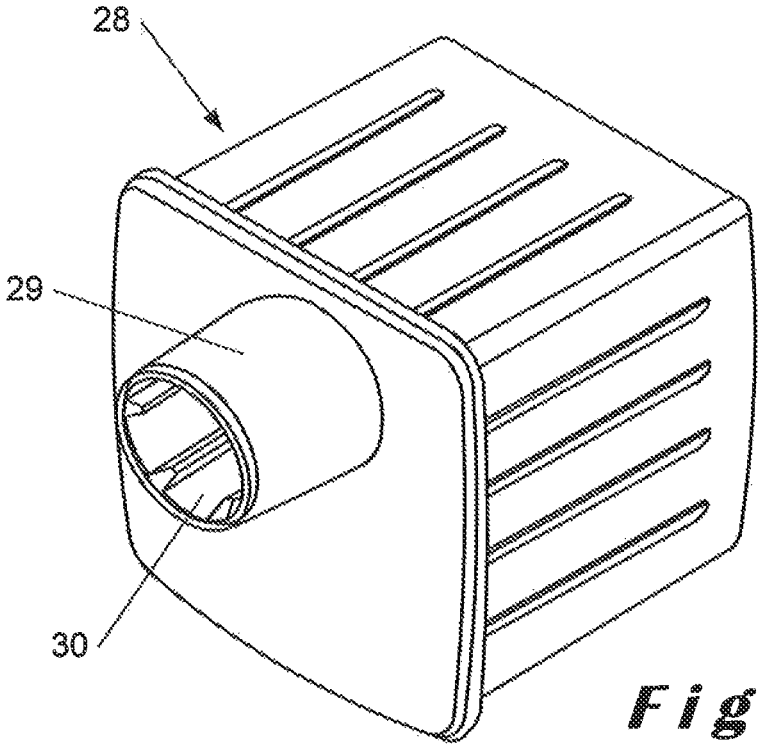
FIG. 6 shows a preferred embodiment of the beam member of a modular height adjustment system according to the present invention.

The connector 14 of the modular height adjustment system may be connected directly to a rotatable transverse beam 7 or may be connected to a beam member 28 mounted to an end part of the rotatable transverse beam 7. The use of a beam member 28 is preferred because it results in lower replacement costs and is able to absorb part of the forces exerted onto the rotatable transverse beam 7 by the connector 14. The connection between the beam member 28 and the connector 14 may be provided by any means considered suitable by the person skilled in the art, for instance by means of a fixing screw which is provided to connect the connector 14 and the beam member 28 (not shown). A preferred embodiment of a beam member 28 for use in a modular height adjustment system is shown in FIGS. 3 and 6. The beam member 28 shown in FIG. 6 comprises a first side which is mounted to an end part of the rotatable transverse beam and a second side, opposite the first side, which comprises means 30 for cooperating with the first connector region 16. The cooperating means 30 can be any means considered suitable by the person skilled in the art. The cooperating means as shown in FIG. 6 comprises a protruding part 29 which extends in longitudinal direction of the eccentric axis and which is accessible from outside the outer frame. Preferably, said protruding part 29 comprises a recess which is provided to receive at least part of the first connector region 16 of the connector 14 as is shown in FIGS. 3 and 6. The cooperating means can for instance also be a recessed part which cooperates with a protruding part of the connector. The use of a beam member 28 has the advantage it can be made separate from the rotatable transverse beam 7. Another advantage is again that is results in lower replacement costs because not the whole rotatable transverse beam needs to be replaced in case there is damage to the part receiving the first connector region. The rotatable transverse beam 7 may comprise a beam member 28 at one longitudinal side of the outer frame or at both longitudinal sides as shown in FIG. 3.

Figure 7:
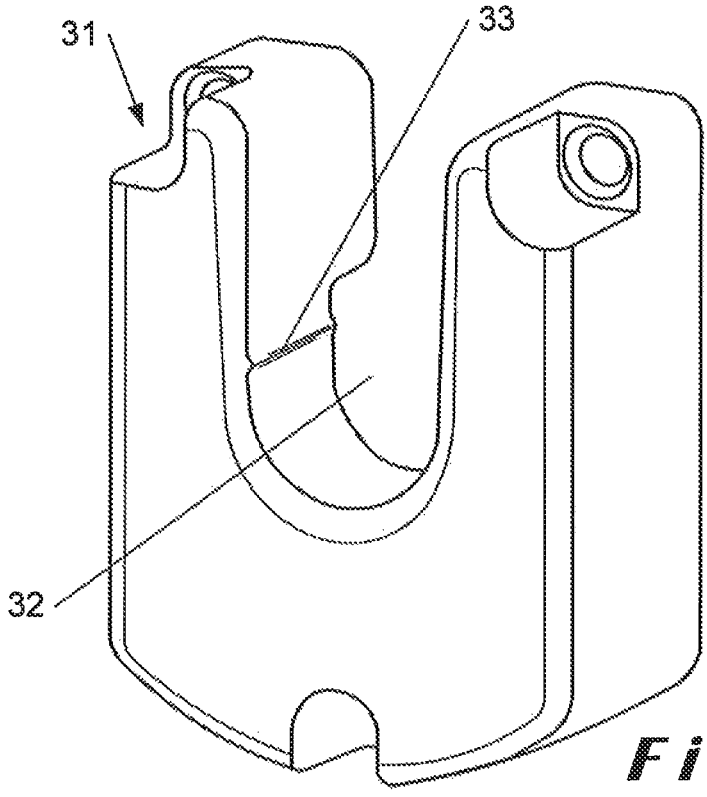
FIG. 7 shows a preferred embodiment of the beam supporting member of a modular height adjustment system according to the present invention.

Preferably, said height adjustment system further comprises a beam supporting member 31, which comprises a recess 32 for receiving and supporting at least part of said protruding part 29 of said beam member and which is provided to be mounted onto an inner side of the outer frame of said mattress supporting system 1 and which is provided to guide the rotation of said at least one rotatable transverse beam. A preferred embodiment of such a beam supporting member is shown in FIGS. 3 and 7. The beam supporting member shown in FIG. 7 is a U-shaped member which comprises a U-shaped recess and which is with a first side connected to the inner side of the outer frame in such a way that the opening of the outer frame extends between the U-shaped recess 32 of the beam supporting member 31. However, any other type shape of the beam supporting member and the recess considered suitable by the person skilled in the art is possible. The U-shaped recess is provided to receive and support the protruding part 29 of the beam member 28 or of the rotatable transverse beam 7, which is provided to receive the first connector region 16 of the connector 14 and guide the rotation of said at least one rotatable transverse beam 7. Such a beam supporting member has the advantage that it is able to absorb part of the forces exerted onto the mattress supporting structure and in particular to the rotatable transverse beams. Preferably, said beam supporting member comprises a noise absorbing layer provided to absorb at least part of the noise produced by friction between the connector and/or the protrusion of the beam member or rotatable transverse beam itself and the beam supporting member. Preferably, said U-shaped recess further comprises a sleeve 33 provided for reducing the displacement of the protrusion in height direction of the outer frame as shown in FIG. 7. The beam supporting member may be provided at one end of the rotatable transverse beam or at both ends as shown in FIG. 7.

Preferably, said height adjustment system further comprises a transition system which allows transitioning from the installment part to the blocking part of said second connector region of the connector and vice versa. Preferably, said transition system comprises a spring construction 34 mounted between said connector and said beam member or said rotatable transverse beam as is shown in FIG. 3. The spring construction 34 may be mounted on any position with respect to the connector, for instance inside or outside of the hollow cylinder of the connector. In case the connector is connected by means of a fixing screw to the rotatable beam or beam member, the spring is preferably mounted such that it surrounds at least part of the screw. By pushing the connector 14 towards the rotatable transverse beam 7, the spring 34 is compressed between part of the connector and part of the beam member and the connector 14 is pushed with its blocking part 21 out of the corresponding blocking part 25 of the housing 24 or the outer frame 2. The connector 14 may then be rotated freely and a desired height position of the rotatable transverse beam may be installed. After rotation of the connector 14, the spring construction 34 automatically pushes the connector 14 back towards the outer frame 2 such that its blocking part 21 fits into a corresponding blocking part 25 of the housing 24 or the outer frame 2, such that the desired height position is blocked. As a result, such a transition system, and in particular, such a spring construction 34 allows obtaining in one step a height adjustment and a blocking of the desired height.

Preferably, said modular height adjustment system further comprises an indication system 35 which is mounted onto the connector and which is visible from outside the outer frame 2 and which is provided to visually indicate the height position of the at least one rotatable beam 7. Such an indication system 35 has the advantage that the user, wishing to adjust the height of the mattress supporting structure 1 at a specific location, directly observes what the specific height position of that rotatable transverse beam 7 is. Such a visual feedback system 35 also allows the producer to provide the user with an orthopaedic advice and to visualize it. The indication system 35 may take the form of a circular ring-shaped member as is shown in FIG. 3, being divided in a number of different colors that correspond to the number of different height positions which are possible. In FIG. 3, the indication system 35 comprises four colors which correspond to the four different height positions of the quadrangular rotatable transverse beam connected to the height adjustment system. The indication system 35 may however be any other type of indication system 35 considered suitable by the person skilled in the art. It may be completely visible from outside or only that part which indicates the specific height. The indication can be done by colors, numbering or any other type of indication may be used.

The different parts of the modular height adjustment system of the mattress supporting structure according to the present invention can be made from any material considered suitable by the person skilled in the art, such as a plastic material, a metallic material or a wooden material.

The invention claimed is:

1. A bed system comprising a mattress supporting structure (1) which comprises an outer frame (2) having a first and a second transverse side (5, 6) on opposite transverse sides of the frame and a first and a second longitudinal (3, 4) side on opposite longitudinal sides of the outer frame;

a plurality of adjacent transverse beams (7), each of the transverse beams being connected with a first transversal end to the first longitudinal side (3) of the outer frame (2) and with a second transversal end to the second longitudinal side (4) of the outer frame (2), at least one of said transverse beams being a multi-angular transverse beam (7) having a plurality of transverse beam sides (8, 9, 10, 11) and being rotatable about an eccentric rotation axis (12) which is accessible from outside said outer frame (2), a plurality of springs (13) completely movable in a height direction and provided within the outer frame (2) and mounted on top of the plurality of said transverse beams (7), and a height adjustment system which comprises said at least one rotatable transverse beam (7) for completely moving at least one of the springs in a height direction and a rotation imparting connection (14) comprising a first connector region (16) engaging the at least one rotatable transverse beam (7) and a blocking part (21) cooperating with the outer frame (2), which connector (14) is accessible from outside the outer frame along a longitudinal side of the outer frame (2) and which is provided for imparting a rotation to said at least one rotatable transverse beam (7) about its eccentric axis (12), wherein said rotation imparting connector (14) is displaceable between a first and a second position, said first position being provided for disengaging the blocking part (21) from cooperating with the outer frame (2) and rotating said as least one rotatable transverse beam (7) about its eccentric axis (12) and said second position being provided by the blocking part (21) cooperating with the outer frame (2) for blocking said at least one rotatable transverse beam (7) in a desired position with respect to said outer frame (2).

2. A bed system according to claim 1, wherein said plurality of springs (13) is provided to be directly supported by one of said transverse beam sides (11).

3. A bed system according to claim 1, wherein said bed system comprises a plurality of adjacent multi-angular rotatable transverse beams (7) spaced from each other in the longitudinal direction of the outer frame (2).

4. A bed system according to claim 3, wherein at least two of said rotatable transverse beams (7) have a different multi-angular cross section.

5. A bed system according to claim 1, wherein said rotation imparting connector (14) is connected to said at least one rotatable transverse beam (7), said connector being provided to cooperate with the outer frame (2) and to impart rotation of the at least one rotatable transverse beam (7) about its eccentric rotation axis (12), said connector (14) comprising a gripping member (15) which is accessible from outside the outer frame (2) to permit rotating said connector (14) and said at least one beam (7), said connector (14) further comprising in longitudinal direction of said at least one rotatable transverse beam, a first connector region (16) provided to engage a corresponding first beam region positioning means (30) of said eccentric rotation axis (12) of said at least one rotatable transverse beam (7)

and a second connector region (19) having an installment part (20) to permit rotating said connector (14) and said rotatable beam (7) about its eccentric axis (12) with respect to the outer frame (2) and having a blocking part (21) to permit blocking of said connector (14) and said rotatable beam (7) in a desired position.

6. A bed system according to claim 5, wherein said height adjustment system further comprises a housing (24) mounted in a recess of the first longitudinal side of the outer frame (2) for receiving the connector (14), said housing (24) comprising a housing blocking part (25) provided to cooperate with the blocking part (21) of the connector to permit blocking of the at least one rotatable beam (7) in a desired position.

7. A bed system according to claim 6, wherein said second connector region (19) comprises in longitudinal direction of the at least one rotatable beam, a corrugated part (21) comprising a number of alternating protrusions (22) and recesses (23) which are provided to cooperate with corresponding recesses (27) and protrusions (26) of the housing (24) or the outer frame (2), and a smooth part (20) to permit rotation of the connector (14) and said rotatable transverse beam (7) about the eccentric rotation axis (12).

8. A bed system according to claim 7, wherein said height adjustment system further comprises a beam member (28) mounted to an end part of the at least one rotatable transverse beam (7), the beam member (28) comprising positioning means (30) provided to engage the first connector region to fix the position of the beam member (28) on the at least one rotatable transverse beam (7).

9. A bed system according to claim 8, wherein said positioning means (30) comprise a protruding part (29) which extends in longitudinal direction of the eccentric axis (12) and which protrudes from the at least one transverse beam towards the outer frame (2).

10. A bed system according to claim 9, characterized in that said height adjustment system comprises a beam supporting member (31) mounted to an inner side of the outer frame (2) of said mattress supporting system, said beam supporting member (31) comprising a recess (32) for receiving at least part of said protruding part (29) of said beam member (28) with the aim of guiding the rotation of said at least one rotatable transverse beam (7).

11. A bed system according to claim 10, wherein said height adjustment system further comprises a spring construction (34) mounted between said connector (14) and said beam member (28) to facilitate transition of the connector (14) from the installment part (20) to the blocking part (21) of said second connector region (19) and vice versa.

12. A bed system according to claim 11, wherein said height adjustment system further comprises an indication system (35) which is mounted onto the connector and which is visible from outside and which is provided to visually indicate the height position of the at least one rotatable beam (7) and means for unblocking the connector (14) in a desired position by pushing the connector (14) towards the rotatable transverse beam (7).

* * * * *